US006079975A

United States Patent [19]

Conover

[11] Patent Number: 6,079,975

[45] Date of Patent: Jun. 27, 2000

[54] MULTI-LAYER CANDLE HAVING DIFFERENT FRAGRANCES IN EACH LAYER

[76] Inventor: Donald R. Conover, 4247 Bloomington La., Arlington Heights, Ill. 60004

[21] Appl. No.: 08/302,991

[22] Filed: Sep. 14, 1994

[51] Int. Cl.[7] ..... F23D 3/16

[52] U.S. Cl. ..... 431/288; 422/126

[58] Field of Search ..... 431/288; 422/125, 422/126

[56] References Cited

U.S. PATENT DOCUMENTS

| | | | |
|---|---|---|---|
| 2,229,131 | 1/1941 | Root | 431/288 |
| 3,000,753 | 9/1961 | Rockland | 431/288 |
| 3,898,039 | 8/1975 | Lin | 422/125 |
| 3,958,917 | 5/1976 | Naz | 422/126 |
| 4,427,366 | 1/1984 | Moore | 422/126 |
| 4,568,270 | 2/1986 | Marcus et al. | 431/288 |

*Primary Examiner*—Carroll Dority
*Attorney, Agent, or Firm*—Hill & Simpson

[57] ABSTRACT

A multi-layer candle in which each layer has a different fragrance so that as the candle burns, the different fragrances merge to form new fragrances from the mixtures thereof. The multi-layer candle may be conical or cylindrical-shaped or may have other selected shapes.

7 Claims, 1 Drawing Sheet

MULTI-LAYER CANDLE HAVING DIFFERENT FRAGRANCES IN EACH LAYER

BACKGROUND OF THE INVENTION

1. Field of the Invention

This invention relates in general to candles and, in particular, to a novel multi-layer candle which has different fragrances in each of the vertical layers.

2. Description of Related Art

Candle with fragrances are well known in the art. However, candles which are formed with an inner conical or cylindrical shape that has a first fragrance and which is surrounded by another or multiple vertical, conical or cylindrical layers of candle material each having a different fragrance is not known.

SUMMARY OF THE INVENTION

The present invention relates to a multi-cylindrical layer candle wherein each layer has a different fragrance so that as the candle burns, the different fragrances, which are compatible with the previous fragrances, will blend to form unique fragrances which are emitted as the candle burns.

It is a feature of the invention to provide a multi-cylindrical layer candle wherein a first layer has a first fragrance and the first layer is surrounded by one or more additional layers, each of which has a different fragrance. As the candle burns, the fragrances in the different layers blend to provide a new and novel mixed fragrance.

It is another feature of the invention to provide a cylindrical or conical-shaped candle which is formed with one or a number of layers and wherein the central layer and the coating layers each have different fragrances.

It is a feature of the invention to provide a novel candle wherein a wick is dipped into a first candle melted solution and coated therewith and wherein the first candle solution has a first fragrance after which the hardened candle is dipped into a second and further candle melted solution each of which contain a different fragrance so as to form a multi-layer candle with each layer having a different fragrance which will blend with one another as the candle burns, creating a new and different aroma.

It is another feature of the present invention to provide a method for molding a multi-layer candle wherein a wick is molded in a first mold with candle material having a first fragrance after which the candle from that mold is molded in a second layer mold with candle material having a second fragrance. Subsequently, an additional mold forms, a third layer with a different fragrance onto the candle.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

DESCRIPTION OF THE PREFERRED EMBODIMENTS

Figure 1:
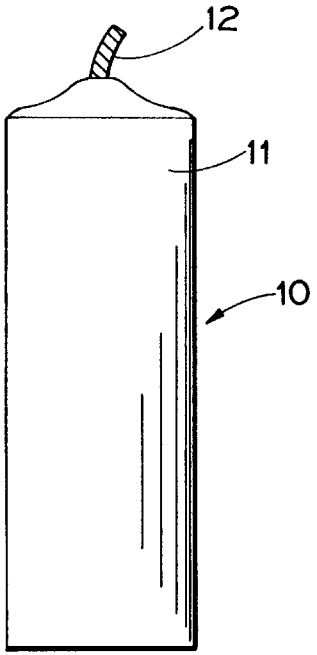
FIG. 1 is a side plan view of a candle according to the invention.

FIG. 1 illustrates a candle 10 which has a main body portion 11 from which extends a wick 12 that extends partially or substantially through the length of the candle. The candle 10 is formed with a first cylindrical or conical portion 14 which surrounds the wick 12 and the first portion 14 includes a first fragrance which might be, for example, wild rose, which is inserted into the paraffin wax of the first portion, 14 before the candle is formed by molding or dipping or in any other known process for making candles.

Figure 2:
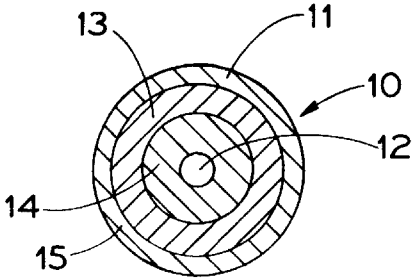
FIG. 2 is a sectional view illustrating the different layers which contain different fragrances of the candle.

After the portion 14 has been formed, a second layer 13 is formed about the first portion 14 and the second layer 13 has a second fragrance such as hyacinth. A third layer 15 is formed about the second layer 13 and it has a third fragrance such as honeysuckle. It is to be realized that additional layers each having different fragrances may also be added to the candle 10 illustrated in FIGS. 1 and 2.

It is to be realized, of course, that the candle 10 may be formed of only two layers including the central layer 14 and a second layer 13 each of which have different Fragrances or it also may be formed of multiple layers greater than three each of which have different fragrances.

An almost infinite combination of fragrances can be combined in the multi-layer candle as, for example, the first layer might be peppermint fragrance and the second layer might be chocolate fragrance. Another combination could be cherry fragrance in the first layer and vanilla fragrance in the second layer.

In a particular example of a multi-fragrance candle according to the invention, which had three layers each having different fragrance, the fragrances comprised 5% and the paraffin wax comprised 95% by weight. In the first layer which was wild rose, 1½% of wild rose fragrance was used in the center portion of the candle. In the second layer, 3% of hyacinth was used in the second layer and in the third layer ½% was used in the third layer of honeysuckle so that the fragrance total of 5%, by weight, of the entire candle was optional.

Figure 3:
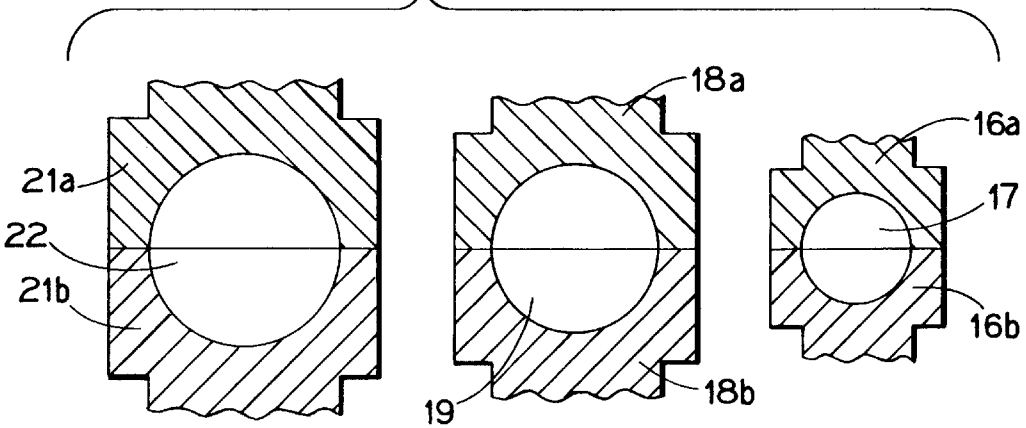
FIG. 3 illustrates three molds for forming the multi-layer candle of the invention.
Figure 4:
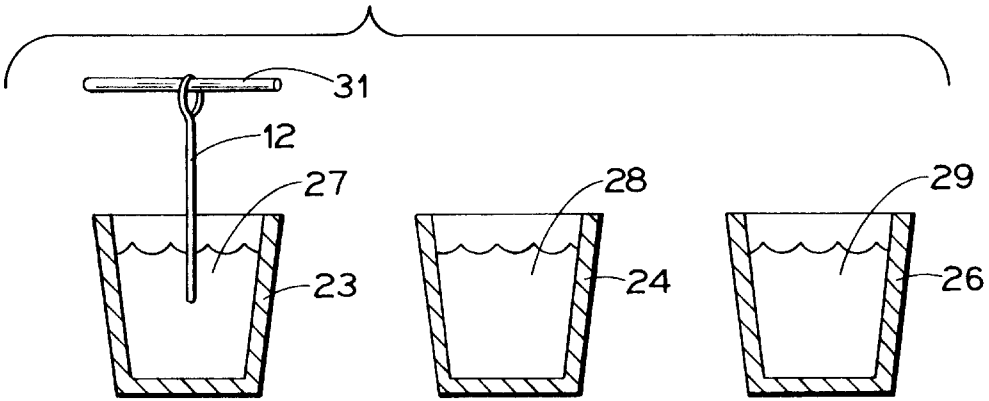
FIG. 4 illustrates three dipping containers for preparing a multi-layer candle according to the invention.

FIGS. 3 and 4 illustrate two examples of methods for making the multilayered candle. In FIG. 4, the multi-layer candle is made by dipping a wick 12 in a first container 23 which has molten paraffin candle wax 27 therein which contains a first fragrance such as vanilla. A holder 12 supports the wick 12 for dipping. After a sufficient quantity of the material 27 has hardened on the wick 12 during the clipping process, the initially formed candle and wick 12 are then dipped in a second container 24 which contains molten candle material 28, which has a second fragrance as, for example, hyacinth. The candle is then dipped in the material 28 until a sufficient quantity of the material 28 has hardened about the center portion. Then the two-layer candle is dipped in a third container 26 into a candle solution 29 which has a third fragrance such as honeysuckle until the candle is completed. It is to be realized, of course, that the candle may have only two layers or, alternatively, may have three or four or any desired number of layers by continuing the process described.

FIG. 3 illustrates a multiple mold process wherein the wick 12 is first molded in a first mold 16*a* and 16*b* into which candle material such as paraffin wax in a molten form is poured so as to harden about the wick 12. The material 17 includes a first fragrance. Subsequently, the first candle portion from mold 16*a* and 16*b* is placed in a second larger mold having portions 18*a* and 18*b* which is then filled with molten candle material 19 that has a second fragrance. Then the two layer candle is removed from the mold 18*a* and 18*b* and inserted into a third larger mold 21*a* and 21*b* into which a third molten candle material 22 is inserted which has a third fragrance. The three-layer candle 10 is then removed from the third mold 21*a* and 21*b*. It is to be realized, of course, that additional molds may be utilized to make candles having additional layers which have different fragrances.

The multi-fragrance candle might also be made by making pie-shaped segments of candle wax each having different fragrances which are then joined together by partially melting the surfaces and bonding them together and by passing holding rings around the segments to form a cylindrical or conical candle, such that as the candle is burned, the different candle materials having different fragrances melt and run together so that the fragrances in the different materials blend to form a new fragrance which comprises a blend of the individual fragrances. The candle may also have a shape other than cylindrical or conical as long as the various waxes having different fragrances run together as the candle is burned.

The fragrances in the different layers can remain separated until the candle is burned by coating the first conical or cylindrical layer with a substance such as with selected glycerol esters or glycerol oleate and then coating the second layer with an ethylene vinyl acetate. The third layer may be coated with glycerol ester and the fourth layer with ethylene vinyl acetate. Each adjacent layer is coated with a different separating material so that the fragrances are partitioned from each other until the candle is burned.

Any combination of known fragrances can be used in the multi-layer candle of the present invention, and although the invention has been described with respect to preferred embodiments, it is not to be so limited as changes and modifications can be made therein which are within the full intended scope as defined by the appended claims.

I claim as my invention:

1. A candle comprising, a first candle portion comprising a first fragrance in which a wick is mounted, a second candle portion comprising a second fragrance, said second candle portion being attached to said first candle portion such that as the candle burns the melted first and second candle portions merge so that a combination fragrance results which is a combination of said first and second fragrances, wherein the first or second candle portion is coated with a glycerol ester and the other of the first or second candle portion is coated with an ethylene vinyl acetate.

2. A candle according to claim 1 wherein the concentration of said first and second fragrances in said first and second candle portions may each vary in ranges from 0.001% to 10% by weight.

3. A candle according to claim 1 wherein said first candle portion is conical shaped, and said second candle portion is formed as a layer about said first candle portion.

4. As candle according to claim 1 wherein said first candle portion is cylindrical-shaped and said second candle portion is formed as a layer about said first candle portion.

5. A candle according to claim 1 including a third candle portion which has a third fragrance in engagement with said second candle portion such that as said candle burns the melted first, second and third candle portions merge so that a combination fragrance results which is a combination of said first, second and third fragrances.

6. A candle according to claim 1 wherein said candle is formed by molding said first candle portion, and then molding said second candle portion about said first molded portion.

7. A candle according to claim 1 wherein said candle is formed by dipping said wick into a first molten candle solution to form said first portion, and then by dipping said first portion into a second molten solution to form said second portion.

* * * * *